US006137067A

United States Patent [19]

Helms et al.

[11] Patent Number: 6,137,067

[45] Date of Patent: Oct. 24, 2000

[54] PUSHBUTTON HAND DRYER TIMER

[75] Inventors: Valerie Helms, Baxter; Michael M. Abell, Sparta, both of Tenn.; Robert B. Zajeski, Lockport, Ill.

[73] Assignee: France/Scott Fetzer Company, Fairview, Tenn.

[21] Appl. No.: 09/333,250

[22] Filed: Jun. 15, 1999

[51] Int. Cl.[7] ..... H01H 43/00; H01H 3/00

[52] U.S. Cl. ..... 200/38 R; 200/38 A

[58] Field of Search ..... 200/35 R, 38 R, 200/38 A, 38 F, 38 FA, 38 FB, 38 B, 38 BA, 38 C, 38 CA, 38 E, 39 R, 39 A

[56] References Cited

U.S. PATENT DOCUMENTS

| | | | |
|---|---|---|---|
| 2,553,846 | 5/1951 | Clemens | 200/38 A X |
| 2,758,166 | 8/1956 | Aust et al. | 200/38 E |
| 2,792,468 | 5/1957 | Kozikowski | 335/68 |
| 2,892,047 | 6/1959 | Smith | 200/38 A |
| 3,150,241 | 9/1964 | Goodhouse et al. | 200/38 F |
| 3,207,933 | 9/1965 | Rogerson | 200/38 A |
| 3,264,441 | 8/1966 | Jenkins | 200/38 R |
| 3,369,085 | 2/1968 | Saginario et al. | 200/35 R |
| 3,528,315 | 9/1970 | Marquis | 200/38 R |
| 3,548,126 | 12/1970 | Bassett | 200/38 R |
| 3,553,611 | 1/1971 | Briechle | 200/38 A |
| 3,649,781 | 3/1972 | Johnsen et al. | 200/33 B |
| 3,665,348 | 5/1972 | Haydon et al. | 335/68 |
| 3,684,844 | 8/1972 | Wicke et al. | 200/38 BA |
| 3,732,383 | 5/1973 | Voland et al. | 200/38 R |
| 3,735,062 | 5/1973 | Chestnut et al. | 200/38 R |
| 3,737,595 | 6/1973 | Simmons et al. | 200/33 R |
| 3,930,359 | 1/1976 | Flumm et al. | 200/38 FA X |
| 4,307,270 | 12/1981 | Smock | 200/38 R |
| 4,346,271 | 8/1982 | Cushing | 200/38 R |
| 4,381,430 | 4/1983 | Smock et al. | 200/35 R |
| 4,485,281 | 11/1984 | Voland et al. | 200/38 R |

*Primary Examiner*—J. R. Scott

[57] ABSTRACT

A hand dryer timer assembly including a plate with a timer motor mounted on one side of the plate and a switch mounted on an opposite side of the plate. The switch is in electrical communication with, and controls the operation of, the timer motor. A cam is mounted on a drive shaft of the timer motor such that the cam rotates with the drive shaft and also slides longitudinally over the drive shaft. The cam extends through an opening in the plate and has a flange at one end located adjacent the one side of the plate to prevent the one end of the cam from moving past the one side of the plate. The cam further has a cam lobe located on the opposite side of the plate adjacent an actuating arm of the switch. A biasing element is located between the timer motor and the cam and biases the cam to a first position aligning the cam lobe with the actuating arm of the switch.

27 Claims, 2 Drawing Sheets

PUSHBUTTON HAND DRYER TIMER

FIELD OF THE INVENTION

This invention relates generally to the field of appliance controls and, more particularly, to an improved pushbutton hand dryer timer.

BACKGROUND OF THE INVENTION

Timing mechanisms have been utilized for decades in the control of many different appliances. The present invention relates generally to electric dryers, and more particularly to a pushbutton hand dryer of the type commonly found in public rest rooms. With such a hand dryer, a user pushes a button or knob to start a drying cycle. During the drying cycle, a timing motor, a heater and a fan are turned on; and at the end of a drying cycle, as determined by the timing motor, the timing motor, heater and fan are automatically turned off. Such dryers must be simple, rugged and durable in construction and operate with great reliability over a long service life. To achieve such features, the hand dryer should have the fewest possible parts that operate in the simplest possible way. More particularly, it is desirable that the hand dryer timer operate through a timing cycle with the fewest number of switches and other electrical contacts and mechanical parts. A further advantage of such a design is that the resulting product will generally be less expensive to manufacture. Thus, there is a continuing effort to make pushbutton hand dryer timers simpler in construction, more reliable and less expensive, all to the benefit of the consumer.

SUMMARY OF THE INVENTION

The present invention provides an improved pushbutton hand dryer timer that has substantially fewer parts than prior timers and thus, is more easily and reliably assembled and substantially less expensive to manufacture. Thus, the present invention has the advantages of providing a pushbutton hand dryer timer that operates more reliably over a longer service life.

In accordance with the principles of the present invention and in accordance with the described embodiments, the present invention provides a hand dryer timer assembly including a plate with a timer motor mounted on one side of the plate and a switch mounted on an opposite side of the plate. The switch is in electrical communication with, and controls the operation of, the timer motor. A cam is mounted on a drive shaft of the timer motor such that the cam rotates with the drive shaft but can slide longitudinally with respect to the drive shaft. The cam extends through an opening in the plate and has a flange at one end located adjacent the one side of the plate to prevent the one end of the cam from moving past the one side of the plate. The cam further has a cam lobe located on the opposite side of the plate adjacent an actuating arm of the switch. A biasing element is located between the timer motor and the cam and biases the cam to a first position aligning the cam with the actuating arm of the switch.

In one aspect of the invention, the cam lobe extends outward from the cam in a direction generally perpendicular to the drive shaft; and the cam lobe has a generally L-shaped cross-sectional profile.

In another embodiment, the invention provides a method of operating the above-described hand dryer timer by moving the cam in a first direction toward the timer motor to move the cam lobe out of alignment with the lever arm of the switch to disengage the cam lobe from the lever arm, thus permitting the lever arm to move to a position operating the switch and initiating operation of the timer motor. Thereafter, the cam is moved in an opposite direction to again align the cam lobe with the actuating arm of the switch. The method requires continued operation of the timer motor to move the cam lobe into contact with the lever arm of the switch, thereby operating the switch and terminating operation of the timer motor.

These and other objects and advantages of the present invention will become more readily apparent during the following detailed description together with the drawings herein.

DETAILED DESCRIPTION OF THE INVENTION

Figure 1:
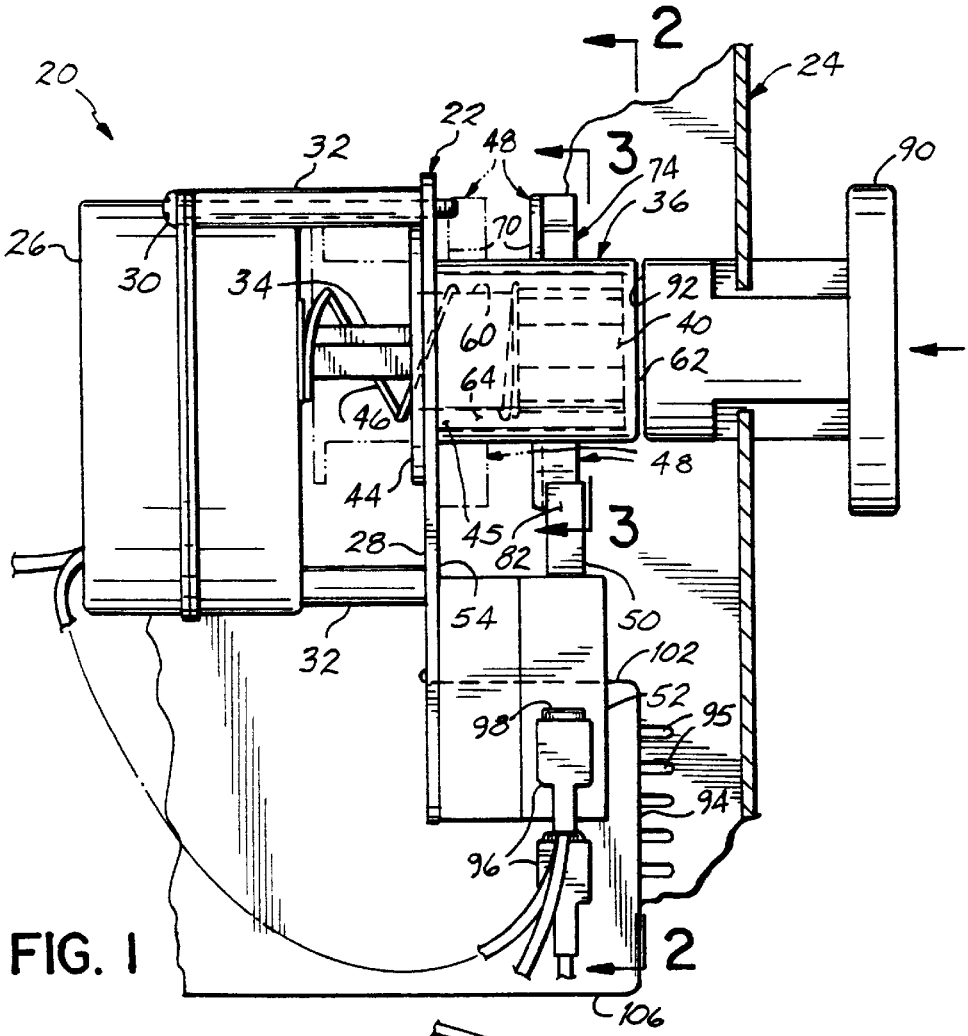
FIG. 1 is a side elevation view of the timer assembly in accordance with the principles of the present invention.
Figure 2:
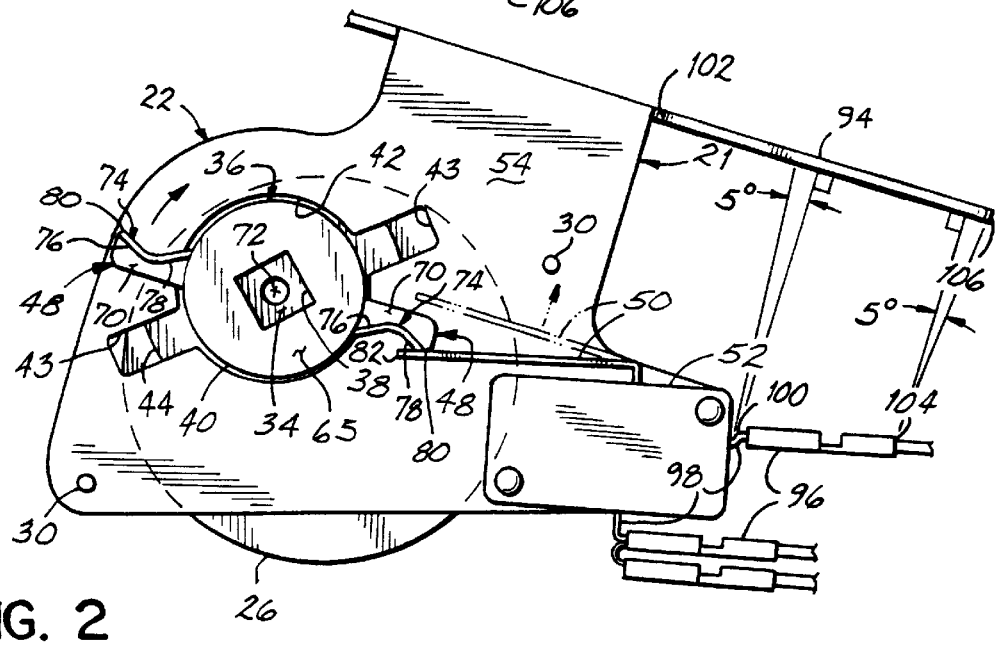
FIG. 2 is a front elevation view of the timer assembly taken along line 2—2 of FIG. 1.

Referring to FIG. 1, a timer assembly 20 includes a bracket 21 (FIG. 2) that includes a mounting or support plate 22. The mounting bracket 21 is attached in a known manner within a pushbutton hand dryer 24. A timing motor 26 of a known construction is mounted to the inner side 28 of the support plate 22 by means of threaded fasteners 30. The fasteners 30 may be threaded into the plate 22 or pass through the plate 22 and secured by nuts (not shown). To maintain the timer motor 26 at a desired distance from the inner side 28 of the support plate 22, the threaded fasteners 30 pass through tubular sleeves 32 of equal length. The motor 26 has an output or drive shaft 34 that preferably has a noncircular cross-sectional profile as shown in FIG. 2.

A cam 36 includes a central longitudinal bore 38 having a noncircular cross-sectional profile similar to that of the output shaft 34, so that the cam 36 can be slidably mounted on the output shaft 34. Thus, any rotation of the output shaft 34 is transmitted directly to the cam 36; however, the cam 36 can slide longitudinally along the output shaft 34. The cam 36 has a main body portion 40 that is preferably cylindrical in shape and extends through a clearance hole 42 (FIG. 2) in the mounting plate 22. The clearance hole 42 includes diametrically opposed slots 43 that permit cam lobes 48 to pass through the support plate 22. A flange 44 is mounted at an inner end 45 of the cam 36 and is larger than the clearance hole 42, thereby restraining the inner end 45 of the cam 36 from fully passing through the clearance hole 42. The flange 44 is pushed or biased against an inner surface 28 of the mounting plate 22 by biasing element, for example, a compression spring 46 thereby defining a first or outermost position of the cam 36. In that outermost position, diametrically opposed cam lobes 48 on the cam 36 are aligned to contact or engage an actuating arm 50 of a microswitch 52. The microswitch 52 is mounted to the outer side 54 of the mounting plate 22.

Figure 3:
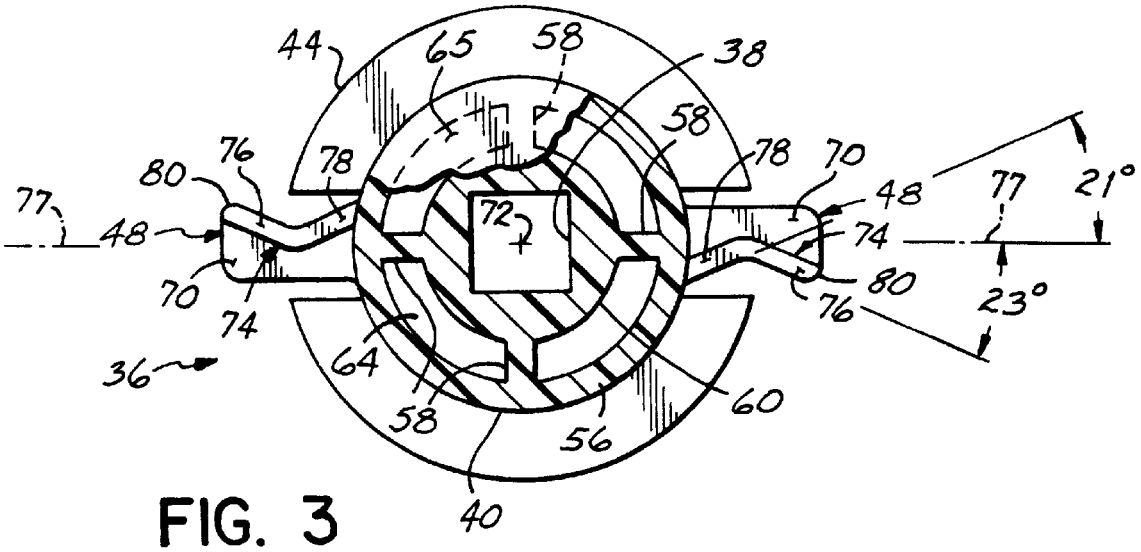
FIG. 3 is a cross-sectional view taken generally along line 3—3 of FIG. 1.

Referring to FIG. 3, the body portion 40 of the cam 36 includes peripheral tubular wall 56 that is connected by means of ribs 58 with a central tubular member 60 that includes the central longitudinal bore 38. The interconnecting ribs 58 extend from an outer end 62 (FIG. 1) of the cam 36 longitudinally through the cam 36 to approximately the location of the cam lobes 48. An annular opening 64 is formed within the cam 36 between the cylindrical inner surface of the peripheral wall 56 and the cylindrical inner surface of the inner tubular member 60. The compression spring 46 is normally sized to be received within the annular opening 64 within the cam 36. A top wall 65 located at the outer end 62 of the cam 36 covers the annular opening 64.

The cam lobes 48 are generally L-shaped, and each lobe 48 has a lower leg or wall member 70 that is in a plane generally perpendicular to the longitudinal centerline 72 of the cam 36 and generally parallel to the plate 22. The wall members 70 strengthen the respective cam lobes 48. Further, each of the L-shaped cam lobes 48 has a side wall 74 extending substantially perpendicularly along a forward edge of the bottom wall 70 toward the outer end 62 of the cam 36. Thus, the side wall 74 is generally perpendicular to the mounting plate 22. Preferably, as viewed from the outer end 62 of the cam 36, the side wall 74 is curved and has a nonlinear cross-sectional profile in a plane perpendicular to the longitudinal centerline 72 of the cam 36 and generally parallel to the mounting plate 22. The side wall 74 of each cam lobe 48 is formed by an inner side wall section 78 and an outer side wall section 76. The inner side wall 78 preferably forms an included angle of approximately 21° with a line 77 bisecting the cam lobes 48 as measured in a plane parallel to the plate 22. The outer side wall 76 preferably forms an included angle of approximately 23° with the line 77 bisecting the cam lobes 48 as measured in a plane parallel to the plate 22. Further, a straight line passing through the distal end 80 of the outer side wall section 76 and the point at which the inner side wall section 78 joins the body portion 40 of the cam 36 does not pass through the centerline 72 of the cam 36.

In use, in its quiescent or nonoperating state, referring to FIG. 2, the distal end 80 of an outer wall section 76 of one of the cam lobes 48 is in contact with a distal end 82 of the actuator arm 50 of the microswitch 52. Further, the distal end 80 of the cam lobe 48 is applying sufficient pressure on the actuator arm 50 so as to actuate the switch 52 and hold the normally closed contacts 84 of FIG. 4 in their open state. With the contacts 84 open, power cannot be applied to the timer motor 26, fan motor 86 and heater 88; and the timer motor 26, fan motor 86 and heater 88 remain off. To operate the hand dryer 24, a user depresses or pushes the knob or pushbutton 90 (FIG. 1) of the hand dryer 24. The inner end 92 of the knob 90 contacts the outer end 62 of the cam 36 and moves the cam 36 to the left, as viewed in FIG. 1, over the shaft 34 of the timer motor 26 to a second position illustrated in phantom. As the cam 36 is moved along the output shaft 34 toward its second position, the cam lobe 48 disengages and loses contact with the actuator arm 50 of the switch 52. After losing contact with the cam lobe 48, the actuating arm 50 is then free to pivot to a second position illustrated in phantom in FIG. 2. Upon the user releasing the pushbutton 90, the cam 36 is returned by the biasing spring 34 to its original, first position as illustrated in FIG. 1. Normally, the pushbutton 90 is mounted in the hand dryer 24 with its own return spring. Referring to FIG. 2, the unique shape of the side wall 74 of the cam lobe 48 reduces the potential for, and preferably eliminates interference between the cam lobe 48 and the actuator arm 50 as the cam 36 returns to its original position.

Figure 4:
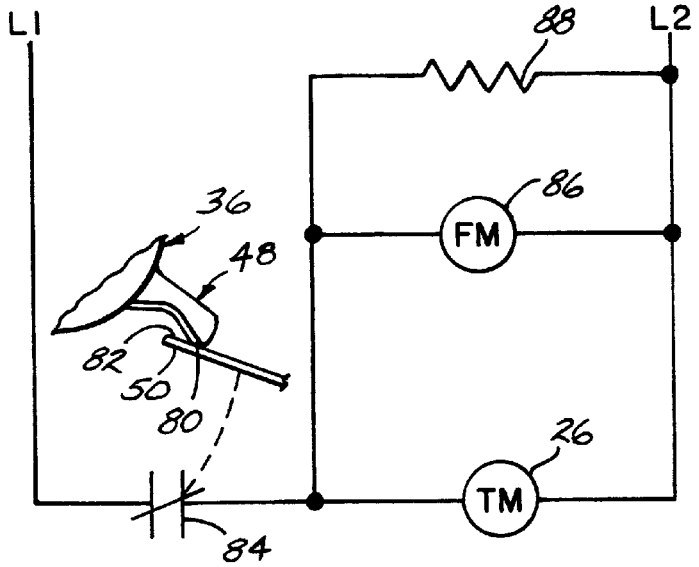
FIG. 4 is a schematic circuit diagram of a pushbutton hand timer in accordance with the principles of the present invention.

After the cam 36 loses contact with and releases the actuator arm 50, the actuator arm 50 pivots to the position shown in phantom in FIG. 2, thereby changing the state of the switch 52, and referring to FIG. 4, closing the normally closed contacts 84. Closing the contacts 84 initiates a drying cycle by applying power to the timer motor 26, the fan motor 86 and the heater 88, thereby turning those devices on. Turning the timer motor 26 on causes the output shaft 34 and cam 36 to rotate in a clockwise direction as illustrated in FIG. 2. The timer motor 26, fan motor 86 and heater 88 continue to operate until rotation of the timer motor 26 causes the distal end 80 of a cam lobe 48 to again contact and depress, or move, the actuating arm 50 of the microswitch 52 to a position at which the switch 52 changes state (FIG. 2). When the switch 52 changes state, the normally closed contacts 84 open; and power is removed from the timer motor 26, the fan motor 86 and the heater 88, thereby turning those devices off and terminating the drying cycle.

The output shaft 34 of the timer motor 26 rotates at an angular velocity such that a drying cycle of a desired duration is achieved during one-half of a full rotation of the output shaft 34. Thus, the cam 36 contains two diametrically opposed cam lobes 48 and provides two full drying cycles for each rotation of the output shaft 34 and the cam 36. As will be appreciated, the number of cam lobes 48 on the cam 36 may be changed to conform to different angular velocities of the output shaft 34 and different desired time periods for the drying cycle.

Another feature of the present invention is that the mounting bracket 21 includes a baffle or shield 94 extending in a direction generally perpendicular from the outer side of the plate 22 and located between a side of the hand dryer 24 and the electrical contacts on the switch 52. Hand dryers often contain a grill or openings 95, and it is possible for items such as coat hangers or other objects to penetrate through those openings and potentially contact electrical connectors 96 and/or electrical contacts 98 of the switch 52. Therefore, it is desirable that the shield 94 be present to prevent the electrical connectors 96 and electrical contacts 98 from being touched by objects being inserted through the openings 95 in the housing of the hand dryer 24. The shield 94 should have a width extending beyond the range of the electrical connectors. Referring to FIG. 2, if a perpendicular line extends from the shield 94 to a point 100 at the base of electrical contact 98 and then rotated 5° counterclockwise with respect to the point 100 as viewed in FIG. 2, the one edge 102 of the shield 94 should extend beyond that 5° line. Similarly, if a perpendicular line extends from the shield 94 to a point 104 at the outermost end of the electrical connectors 96 and then rotated 5° clockwise with respect to the point 104 as viewed in FIG. 2, the other edge 106 of the shield 94 should extend beyond that 5° line. Thus, the shield 94 provides reasonable protection against the electrical connectors 96 and electrical contacts 98 being touched by objects penetrating the hand dryer 24 from its exterior.

The hand dryer timer described with respect to FIGS. 1–4 provides a substantial improvement over prior timer assembly designs. The entire timer assembly has a very few number of parts which substantially reduces the labor time and expense for assembly of the timer. That robust design also provides very reliable operation over a long service life of the hand dryer.

While the invention has been set forth by a description of the preferred embodiment in considerable detail, it is not intended to restrict or in any way limit the claims to such detail. Additional advantages and modifications will readily appear to those who are skilled in the art. For example, in the preferred embodiment, the main body 40 of the cam 36 is cylindrical and the cam lobes 48 extend radially therefrom;

however, as will be appreciated, the cam 36 can have other shapes such as a multilateral shapes or even noncircular shapes in which the cam lobes 48 are mostly or fully integrated within the main body 40 of the cam 36. As will be appreciated, the successful operation of the present invention is independent of the lower wall 70 on the cam lobes 48, and therefore, the low wall 70 may be eliminated. The cam 36 is preferably injection molded from a glass reinforced 66 nylon material commercially available as "ZYTEL" 70G 33L nylon material from Du Pont Corporation. However, the cam 36 may be made from other materials consistent with the desired performance specifications. Further, while the cam 36 is preferably molded of a plastic material as shown herein, the cam 36 may have many other configurations, for example, a solid part, and may be made of other materials such as metal, ceramic, a fiber composition, etc.

As described herein, the noncircular cross-sectional profiles of the shaft 34 and bore 38 are multilateral, for example, square, triangular, hexagonal, etc. Alternatively, the noncircular cross-sectional profiles of the output shaft 34 and bore 38 may be elliptical, star-shaped, splined, etc. Further, as shown, the cross-sectional profile of the output shaft 34 and bore 38 are preferably noncircular. Those cross-sectional profiles may be circular but interconnected such that the cam 36 rotates with the shaft 34 and is able to slide longitudinally with respect to the shaft 34. Such mechanical interconnections are well known and include, for example, a slot and key or simply a diametric pin extending through the cam and a longitudinal slot in the output shaft 34.

In the preferred embodiment, the cam 36 is slidably mounted directly on the drive shaft 34 of the timer motor 26. However, as will be appreciated, the drive shaft 34 can be a spline or similar shaft, and the cam 36 slidably and rotationally mounted independent of the drive shaft 34. The flange 44 of the cam 36 can also be formed with peripheral gear teeth that mesh with the spline or an intervening gear. Thus, the cam 36 can be mounted independent of the drive shaft 34 but be driven rotationally by the drive shaft spline and also slide longitudinally to operate identically to the cam assembly described herein.

In the described embodiment, the compression spring 46 extends into an annular opening 64 within the cam 36. Alternatively, the compression spring 46 may be sized such that it does not fit within the annular opening 64. In that embodiment, the inner end of the cam 36 may be molded with a protruding boss on which the spring 46 may be located.

Further, the timer assembly herein is part of a pushbutton hand dryer timer; however, as will be appreciated, hand dryers as used herein often have an adjustable output duct allowing the drying air to be directed to areas other than the hands, for example, the face and hair. The dryer timer assembly of the present invention is applicable to any "hand dryer" type of dryer which is manually turned on and automatically turns off, thereby operating in an identical or similar fashion to the hand dryer described herein.

Therefore, the invention in its broadest aspects is not limited to the specific detail shown and described. Consequently, departures may be made from the details described herein without departing from the spirit and scope of the claims which follow.

What is claimed is:

1. A hand dryer timer assembly comprising:

a plate;

a timer motor mounted on one side of the plate and having a drive shaft extending in a direction toward the plate;

a switch mounted on an opposite side of the plate and being in electrical communication with the timer motor to control the operation of the timer motor, the switch having an actuating arm extending therefrom;

a cam in mechanical communication with the drive shaft of the timer motor and mounted for sliding motion in a direction generally parallel to the longitudinal centerline of the drive shaft, the cam rotating with the drive shaft and extending through an opening in the plate, the cam having a flange located adjacent the one side of the plate to prevent the cam from moving past the one side of the plate, and a cam lobe located on the opposite side of the plate adjacent the actuating arm of the switch; and a biasing element located between the motor and the cam and biasing the cam to a first position aligning the cam lobe with the actuating arm of the switch.

2. A hand dryer timer assembly comprising:

a plate;

a timer motor mounted on one side of the plate and having a drive shaft extending in a direction toward the plate;

a switch mounted on an opposite side of the plate and being in electrical communication with the timer motor to control the operation of the timer motor, the switch having an actuating arm extending therefrom;

a cam slidably mounted on the drive shaft of the timer motor, the cam rotating with the drive shaft and extending through an opening in the plate, the cam having a flange located adjacent the one side of the plate to prevent the cam from moving past the one side of the plate, and a cam lobe located on the opposite side of the plate adjacent the actuating arm of the switch; and a biasing element located between the motor and the cam and biasing the cam to a first position aligning the cam lobe with the actuating arm of the switch.

3. A hand dryer timer assembly of claim 2 wherein the cam lobe extends outward from the cam in a direction generally perpendicular to the drive shaft.

4. A hand dryer timer assembly of claim 3 wherein the cam lobe has a generally L-shaped cross-sectional profile.

5. A hand dryer timer assembly of claim 4 wherein the cam lobe has a side wall in a plane generally perpendicular to the plate.

6. A hand dryer timer assembly of claim 5 wherein the side wall of the cam lobe has a proximal end connected to a body of the cam and a distal end aligned with the actuator arm of the switch.

7. A hand dryer timer assembly of claim 6 wherein the proximal and distal ends of the side wall of the cam lobe define a line that does not pass through a longitudinal centerline of the cam.

8. A hand dryer timer assembly of claim 6 wherein the side wall of the cam lobe is curved over its length between the proximal and distal ends of the side wall.

9. A hand dryer timer assembly of claim 8 wherein the side wall of the cam lobe has an inner side wall section and an outer side wall section.

10. A hand dryer timer assembly of claim 9 wherein the inner side wall section forms an included angle of approximately 21° with a line bisecting the cam lobe as measured in a plane parallel to the plate.

11. A hand dryer timer assembly of claim 9 wherein the outer side wall section forms an included angle of approximately 23° with a line bisecting the cam lobe as measured in a plane parallel to the plate.

12. A hand dryer timer assembly of claim 7 wherein the side wall of the cam lobe has a nonlinear cross-sectional profile in a plane parallel to the plate.

13. A hand dryer timer assembly of claim 5 wherein the cam lobe has a lower wall generally perpendicular to the side wall and generally parallel to the plate.

14. A hand dryer timer assembly of claim 1 wherein the drive shaft is noncircular and the cam has a noncircular bore for receiving the drive shaft.

15. A hand dryer timer assembly of claim 1 wherein the drive shaft is multilateral and the cam has a multilateral bore for receiving the drive shaft.

16. A hand dryer timer assembly of claim 15 wherein the drive shaft has a square cross-sectional profile and the cam has a bore with a square cross-sectional profile for receiving the drive shaft.

17. A hand dryer timer assembly of claim 14 wherein the bore in the cam is coincident with a longitudinal centerline of the cam.

18. A hand dryer timer assembly of claim 14 wherein the bore in the cam is a through bore.

19. A hand dryer timer assembly of claim 1 wherein the cam has a longitudinally extending annular opening for receiving the biasing element.

20. A hand dryer timer assembly of claim 1 wherein the biasing element is a compression spring.

21. A hand dryer timer assembly of claim 1 further comprising a shield extending generally perpendicular from the opposite side of the plate adjacent the switch.

22. A hand dryer timer assembly of claim 21 wherein the switch includes electrical connectors attached to electrical contacts and the shield extends adjacent the electrical contacts and connectors.

23. A hand dryer timer assembly of claim 22 wherein the shield has one edge extending beyond a line rotated 5° counterclockwise with respect to a base of an electrical contact from a line perpendicular to the shield and intersecting the base of the electrical contact.

24. A hand dryer timer assembly of claim 23 wherein the shield has an opposite edge extending beyond a line rotated 5° clockwise with respect to an outermost tip of an electrical connector from a line perpendicular to the shield and intersecting the outermost tip of the electrical connector.

25. A hand dryer timer assembly comprising:

a mounting bracket having a support plate;

a timer motor attached to one side of the support plate and having a drive shaft extending in a direction toward the support plate;

a switch mounted on an opposite side of the support plate and being in electrical communication with the timer motor to control the operation of the timer motor, the switch having an actuating arm extending therefrom;

a cam mounted on the drive shaft of the timer motor to rotate with the drive shaft and slide longitudinally along the drive shaft, the cam extending through an opening in the motor support member and further having a flange at one end larger than the opening and located adjacent the one side of the support plate, an annular opening at the one end of the cam and extending longitudinally through a portion of the cam, and a cam lobe radially extending from the cam and located on the opposite side of the support plate adjacent the actuating arm of the switch; and a compression spring element having one end bearing against the motor and an opposite end extending into the annular opening, the compression spring biasing the cam to a first position such that the cam lobe is in alignment with and contacts the actuating arm of the switch in response to rotation of the timer motor, thereby operating the switch and terminating the operation of the timer motor, upon the cam being pushed to a second position causing the cam lobe to lose contact with the actuating arm of the switch, the actuating arm of the switch moves in a direction to operate the switch and initiate operation of the timer motor, whereby upon the cam being released and returning to the first position, continued rotation of the timer motor will cause the cam lobe to again contact the actuating arm of the switch and operate the switch to terminate the operation of the timer motor.

26. A hand dryer having holes in a side of the hand dryer comprising:

a plate;

a timer motor mounted on one side of the plate and having a drive shaft extending in a direction toward the plate;

a switch mounted on an opposite side of the plate and being in electrical communication with the timer motor to control the operation of the timer motor, the switch having electrical contacts and connectors;

a cam in mechanical communication with the drive shaft of the timer motor and mounted for sliding motion in a direction generally parallel to the longitudinal centerline of the drive shaft;

a biasing element located between the motor and the cam and biasing the cam to a first position aligning the cam lobe with the actuating arm of the switch; and the plate including a shield extending from the opposite side of the plate to a location between the electrical contacts and connectors on the switch and the holes in the hand dryer.

27. A method of operating a hand dryer timer comprising:

providing a timer motor mounted to one side of a support plate, the timer motor having a drive shaft with a cam slidably mounted thereon, the cam extending through the support plate and placing a cam lobe on an opposite side of the support member in contact with an actuating arm of a switch electrically connected to the timer motor, thereby operating the switch to terminate operation of the timer motor;

moving the cam in a first direction toward the timer motor to move the cam lobe out of alignment with the lever arm and disengage the cam lobe from the lever arm, thereby permitting the lever arm to move to a position operating the switch and initiating operation of the timer motor;

moving the cam in an opposite direction to align the cam lobe with the actuating arm of the switch; and continuing operation of the timer motor to move the cam lobe into contact with the lever arm, thereby operating the switch to terminate operation of the timer motor.

* * * * *